US009689171B1

(12) United States Patent
Cartwright et al.

(10) Patent No.: US 9,689,171 B1
(45) Date of Patent: Jun. 27, 2017

(54) STAGING TRANSPORT ASSEMBLY AND METHOD

(71) Applicant: Staging Concepts Acquisitions, LLC, Minneapolis, MN (US)

(72) Inventors: Dale William Cartwright, Eatons Hill (AU); Travis William Raida, Coon Rapids, MN (US); Jonathan M. Chase, White Bear Lake, MN (US)

(73) Assignee: STAGING CONCEPTS ACQUISITIONS, INC., Minneapolis, MN (US)

( * ) Notice: Subject to any disclaimer, the term of this patent is extended or adjusted under 35 U.S.C. 154(b) by 0 days.

(21) Appl. No.: 15/183,517

(22) Filed: Jun. 15, 2016

(51) Int. Cl.
*E04H 3/28* (2006.01)

(52) U.S. Cl.
CPC ..... *E04H 3/28* (2013.01)

(58) Field of Classification Search
CPC .. E04H 3/28; E04H 3/24; B62B 3/108; B62B 5/0083; A47B 2025/006
USPC ..... 52/7
See application file for complete search history.

(56) References Cited

U.S. PATENT DOCUMENTS 4,779,542 A 10/1988 Staten et al.
4,934,113 A * 6/1990 Hall ..... E04H 3/28 182/223
5,392,718 A * 2/1995 Stevens ..... E04H 3/28 108/167
5,454,441 A 10/1995 Jines
6,511,082 B2 * 1/2003 Shirai ..... B62B 3/008 280/33.991
7,895,792 B1 * 3/2011 Hayden ..... E04H 3/24 108/192
8,215,063 B1 * 7/2012 Francis ..... E04H 3/24 403/109.6
9,199,657 B2 * 12/2015 Martin ..... B62B 5/0083
2005/0011135 A1 1/2005 Hallberg

OTHER PUBLICATIONS

Staging Concepts News Release, Apr. 14, 2016, 1 page.
Staging Concepts, "Start-Up Package Special", 1 page.

* cited by examiner

*Primary Examiner* — Rodney Mintz
*Assistant Examiner* — Daniel Kenny
(74) *Attorney, Agent, or Firm* — Hollingsworth Davis, LLC

(57) ABSTRACT

A staging transport assembly comprises a base plate, an L-shaped attachment piece, a fastener to couple the base plate to the L-shaped attachment piece, a support plate comprising a first surface and an opposing second surface where the second surface is coupled to the base plate, and at least two wheels coupled to the first surface of the support plate. The base plate comprises a first edge having a first protrusion and a second opposing edge having a second protrusion and further comprises a first surface and a second opposing surface. The L-shaped attachment piece includes a short side comprising a cavity configured to receive the first protrusion of the base plate, a first end terminating in a lip, and a second opposing end coupled with a long side disposed along a portion of the first surface of the base plate when the cavity is mated with the first protrusion.

19 Claims, 9 Drawing Sheets

STAGING TRANSPORT ASSEMBLY AND METHOD

FIELD

The present disclosure is directed to portable and modular staging. More particularly, the present disclosure relates to transportable staging platforms.

BACKGROUND

Many venues such as those for educational, religious, sporting, and performing arts organizations do not provide permanent staging structures for performances. Instead, they either rent or own temporary staging equipment. This equipment can be large and unwieldly. For example staging platforms can weigh approximately 100 to 150 pounds and can have dimensions of up to approximately four feet by 8 feet, which presents obstacles to portability and efficient installation.

In the past, staging platforms have been transported with a separate piece of equipment such as a cart or carriage that may be specially designed to accommodate certain platforms. These carts can include manual lifts or hydraulics in order to lift the platforms, and they need to be stored along with the staging equipment. Alternatively, certain staging platforms are designed with an intricate transport system built into the underside of the platform. For example, the platform may be foldable and a system of wheels descends when the platform is folded into a storage position. Both of these approaches can increase the complexity of transporting the platforms and can be costly. Staging systems, and especially platforms, are beneficial when they are affordable, readily transported, easy to set up/take down, and provide a solid stable surface which meets mandated safety requirements.

SUMMARY

Embodiments of the present disclosure provide an alternative to complex and time consuming transport of current staging systems. The assemblies described herein can be implemented with the use of minimal or no tools and use minimal components and accessories. The assemblies mobilize staging components once the assemblies are attached, allowing the staging components, such as platforms, to be easily transported.

One embodiment is directed to a staging transport assembly. The transport assembly comprises a base plate comprising a first edge having a first protrusion, a second opposing edge having a second protrusion, a first surface, and a second opposing surface. The transport assembly also comprises an L-shaped attachment piece, wherein a short side comprises a cavity configured to receive the first protrusion of the base plate, a first end terminating in a lip, and a second opposing end coupled with a long side. The long side is disposed along a portion of the first surface of the base plate when the cavity is mated with the first protrusion. A fastener is configured to couple the base plate to the L-shaped attachment piece. The transport assembly further comprises a support plate comprising a first surface and an opposing second surface where the second surface is coupled to the base plate and at least two wheels are coupled to the first surface of the support plate.

Another embodiment is directed to a portable staging system comprising a staging platform and at least one transport assembly. The staging platform comprises at least one contoured edge surface. The transport assembly comprises at least two wheels coupled to a first surface of a support plate, wherein an opposing, second surface of the support plate is coupled to an attachment assembly. The attachment assembly is hookably engaged with the contoured edge surface of the staging platform.

A further embodiment is directed to a method. The method includes engaging a protrusion of a transport assembly base plate with a first channel and engaging a lip of a transport assembly L-shaped piece with a second channel, different from the first channel. A transport assembly fastener is tightened to rotate the L-shaped piece to dispose a long side of the L-shaped piece adjacent the base plate and fix the transport assembly to a position along the contoured edge. The staging platform is rotated to engage the transport assembly with a support surface, and the staging platform is moved to a second location.

These and various other advantages and features of novelty are pointed out with particularity in the claims annexed hereto and form a part hereof. However, for a better understanding of the disclosure and its advantages, reference should be made to the drawings which form a further part hereof, and to accompanying descriptive matter, in which there are illustrated and described representative examples of apparatuses, systems, and methods in accordance with the disclosure.

DETAILED DESCRIPTION

In the following description of various exemplary embodiments, reference is made to the accompanying drawings that form a part hereof, and in which is shown by way of illustration various embodiments in which the disclosure may be practiced. It is to be understood that other embodiments may be utilized, as structural and operational changes may be made without departing from the scope of the present disclosure.

In accordance with embodiments described herein, a transport assembly for staging platforms is described. The transport assembly can be quickly, and simply, installed on an edge of a staging platform. Therefore, the transport assembly does not affect the structural characteristics, or safety measures, of the platform or of an assembled staging system. The transport assembly can be attached much like other accessory components. While the transport assembly can be quickly attached, it can also be quickly removed. Alternatively, the transport assembly can remain installed on a platform while the platform is in use. This saves time during removal and storage of the staging system.

In various embodiments, a staging system comprises modular and removable non-cementitious filled panels fastened to, and supported by, adjustable, or non-adjustable, height understructures and support legs. The non-cementitious panels may be constructed of a variety of materials; however, one-inch marine grade plywood has been shown to satisfy requisite safety standards. The panels may also be found in a variety of sizes and shapes, although staging panels are commonly rectangular. Depending on their materials and size, panels provided according to some embodiments are maneuverable by one or two adults.

To facilitate attachment to legs or an understructure support system and to other components of a staging system, a panel is encased in a frame to form a platform. The frame both supports and protects the panel. While the frames may be constructed of a variety of materials, aluminum has been shown to have the strength and weight to satisfy applicable safety and construction requirements. For example, an aluminum frame contributes to a lightweight and mobile platform stage assembly. The frame can involve a corner block piece for automatically attaching the platform to a support system during installation. Platforms in a staging system may also include male and female coffin locks for interconnection of multiple platforms and to reduce gaps and misalignment of stage flooring. Further, the frame facilitates attachment of accessory structures, including transport assemblies described herein.

Figure 1A:
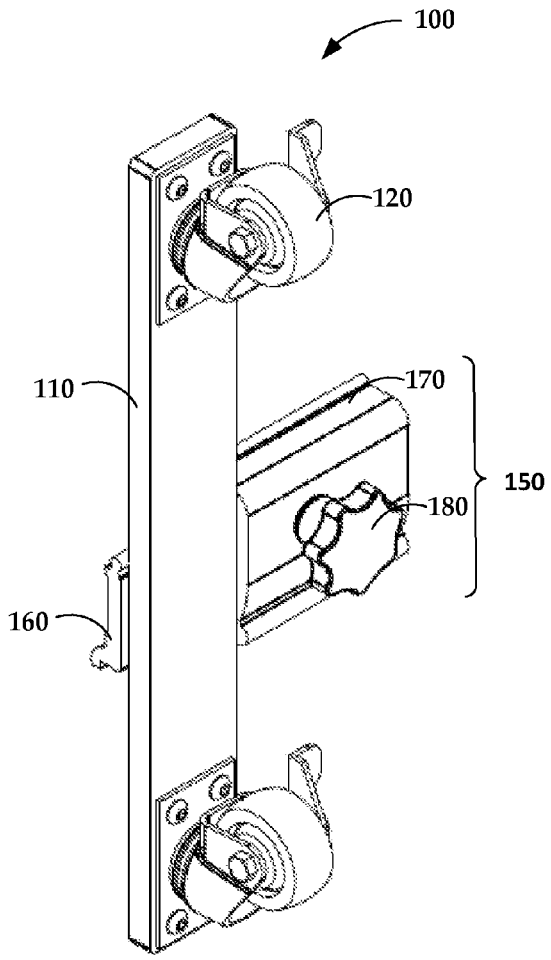
FIGS. 1A-B are perspective views of a transport assembly according to embodiments of the disclosure.
Figure 1B:
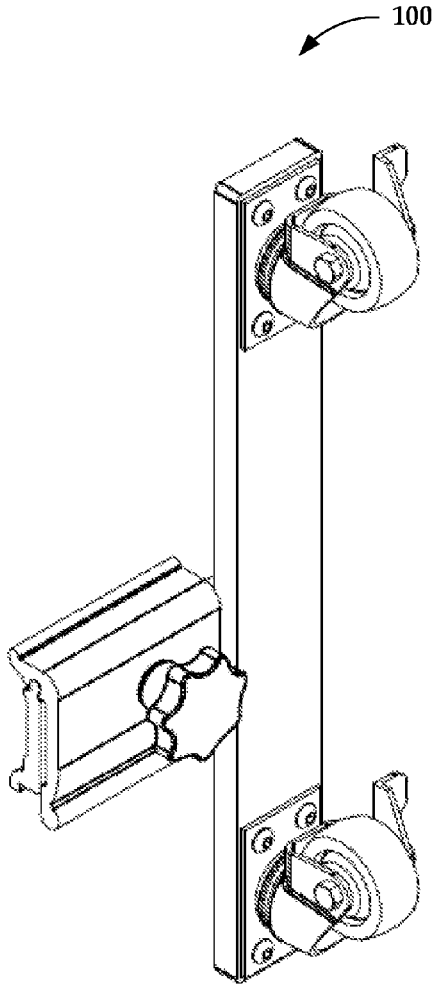

Referring now to FIGS. 1A-B, perspective views of a staging transport assembly 100 are shown. Both figures illustrate a support plate 110 with two wheels 120 attached at opposing ends of the support plate 110. The wheels are shown with casters and locking mechanisms. However, the locking mechanisms are optional and the wheels could include various configurations including stationary or partially-swiveling wheels. Also, instead of a single wheel at each end of the support plate 110, a plurality of wheels may be used, e.g., a tri-wheel caster. Coupled to the support plate 110 is an attachment assembly 150.

The attachment assembly 150 includes a base plate 160, an L-shaped attachment piece 170, and a fastener 180. In FIG. 1A, the base plate 160 extends to the right (as shown in the figure) such that the L-shaped attachment piece 170 and fastener 180 are located to the right of the base plate 110. In FIG. 1B, the base plate 160 extends to the opposing side (to the left as shown in the figure) of the base plate 160. Thus, in FIG. 1B, the L-shaped attachment piece 170 and fastener 180 are located to the left of the base plate 110. Positioning the attachment assembly 150 to opposing sides of the support plate 110 allows for attachment of a transport assembly 100 at opposing ends of a staging platform edge. This is described further herein with respect to FIG. 8.

To attach the base plate 160 to the support plate 110 at various locations (e.g., at least two) along the base plate 160, the base plate 160 includes one or more apertures at one or more locations. For example, the base plate 160 can include two holes, one at each end of the base plate 160 for positioning the base plate in a "left" or a "right" configuration dependent upon which end of a platform the transport assembly will be implemented. Alternatively, the base plate 160 could include a slot along the length of the base plate 160 for securing the base plate 160 to the support plate 110 at any variety of positions along the base plate 160.

Figure 2A:
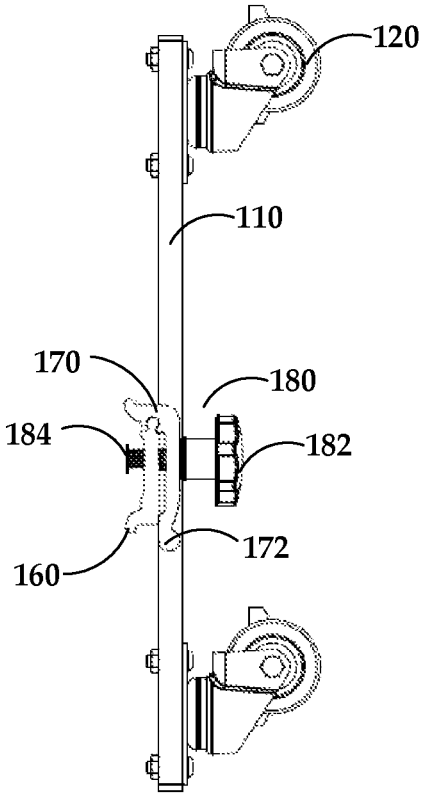
FIGS. 2A-B are side views of a transport assembly according to embodiments of the disclosure.
Figure 2B:
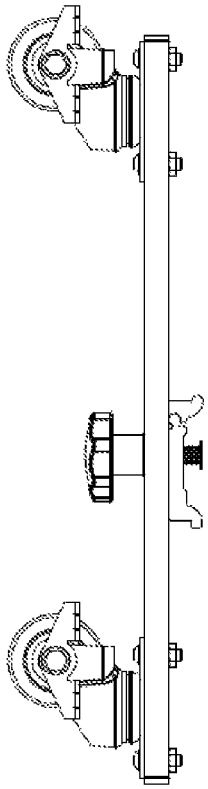

FIGS. 2A-B illustrate side views of the transport assembly of FIG. 1B. FIG. 2A shows the attachment assembly in the foreground, and FIG. 2B shows the attachment assembly behind the support plate 110. As can be seen, the fastener 180 includes a handle 182 and an extended portion 184 that extends through the L-shaped attachment piece 170 and the base plate 160. The fastener 180, by securing the L-shaped attachment piece 170 to the base plate 160, also secures the attachment assembly to the edge of a platform. This is further described below in connection with FIG. 4. To secure the L-shaped piece 170, the fastener 180 is tightened by rotating the handle 182 thereby swinging the end of the long side 172 of the L-shaped piece 170, which is hinged with the base plate 160, into contact with the base plate 160. While the various elements of the transport assembly can be any variety of sizes (e.g., lengths and thicknesses), the L-shaped piece 170 is shown as having the same thickness, or less, than the support plate 110 when both are attached to the base plate 160.

Figure 2C:
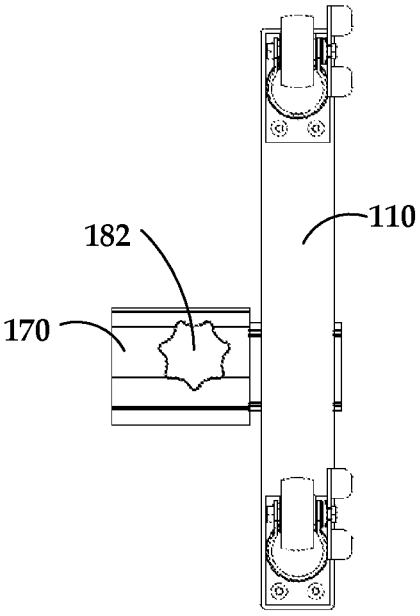
FIG. 2C is a front view of a transport assembly according to embodiments of the disclosure.

FIG. 2C illustrates a front view of the transport assembly shown in FIGS. 2A-B. While the L-shaped piece 170 is shown spaced apart from the support plate 110 along the base plate 160, it could also be positioned directly adjacent, or flush, to the support plate 110. Also, the fastener handle 182, e.g., a tightening knob, can have any variety of shapes and/or sizes to facilitate rotation of the fastener 180.

Figure 3A:
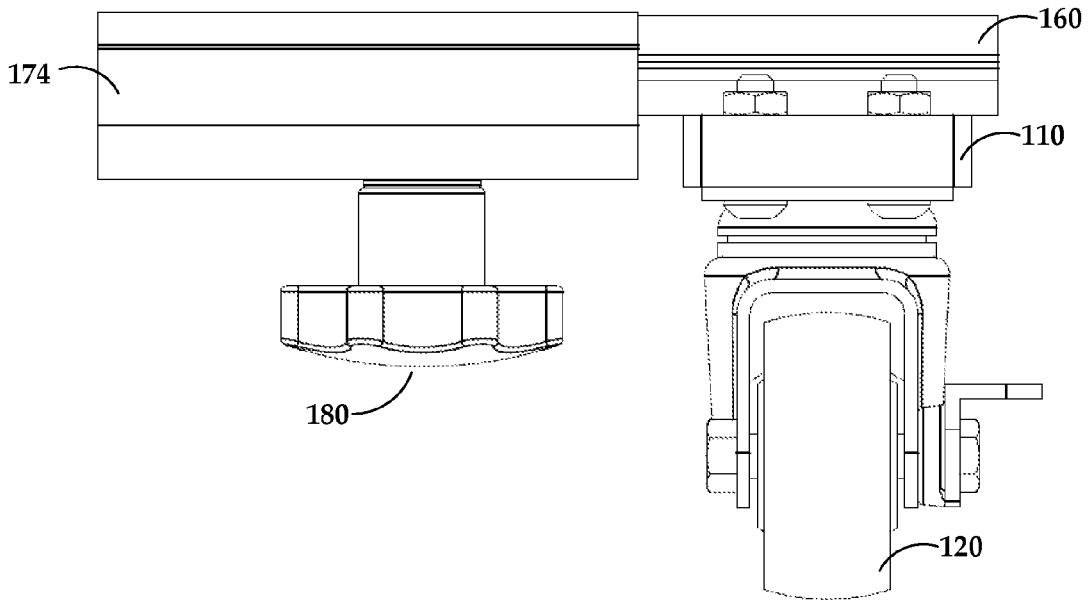
FIG. 3A is a top view of a transport assembly according to embodiments of the disclosure.
Figure 3B:
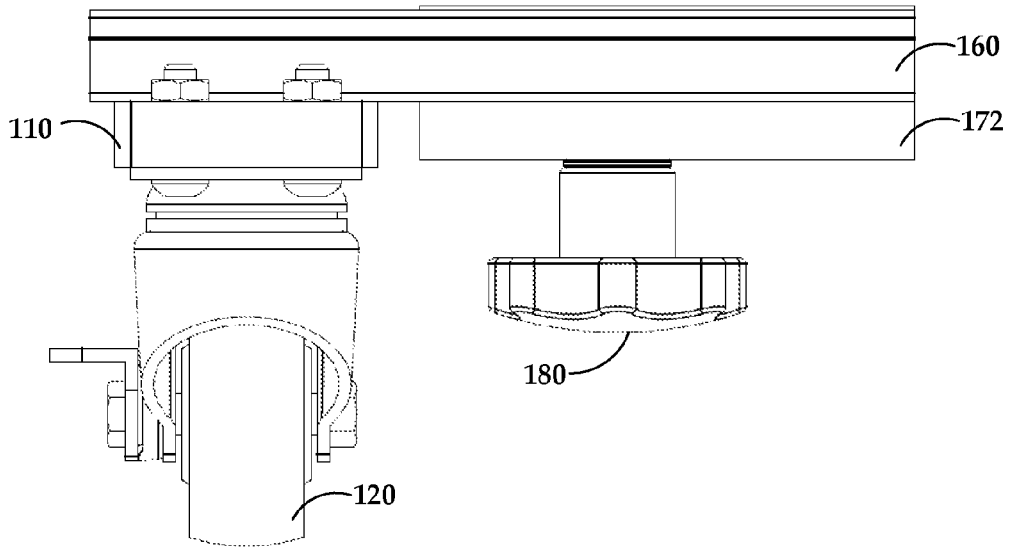
FIG. 3B is a bottom view of a transport assembly according to embodiments of the disclosure.

Further, FIG. 3A is a top view of the transport assembly 100 shown in FIG. 1B, and FIG. 3B is a bottom view of the same transport assembly 100. In FIG. 3A, the short side 174 of the L-shaped piece 170 is shown spaced apart from the support plate 110 as both are attached to the base plate 160. As can be seen, the amount of the fastener, including the handle, which protrudes away from the base plate 160, is less than the height of the wheel 120. The opposing, bottom, view of FIG. 3B shows the end of the long side 172 of the L-shaped piece 170 in contact with the base plate 160.

Figure 4:
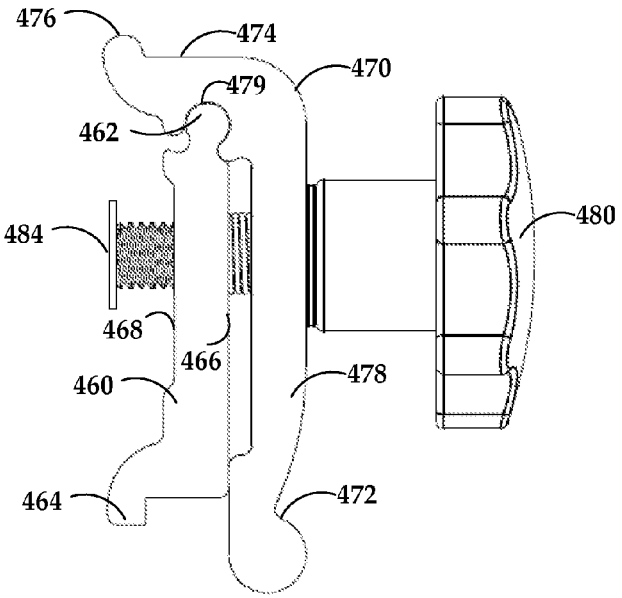
FIG. 4 is a side view of an attachment assembly according to embodiments of the disclosure.

A more detailed view of an attachment assembly is provided by the side view of FIG. 4. The base plate 460 comprises a first edge having a first protrusion 462 and a second opposing edge having a second protrusion 464. The first protrusion 462 is shown as being rounded to facilitate the L-shaped attachment piece 470 hinging, or rotating, about the first protrusion 462. However, the first protrusion 462 can take any variety of shapes that will accommodate the hinging motion of the L-shaped piece 470. The second protrusion 464 forms a lip that is configured to hookably engage with a channel of a contoured staging platform edge. The base plate 460 further comprises a first surface 466 and a second opposing surface 468. The L-shaped attachment piece 470 includes a short side 474 and a long side 478. The short side 474 comprises a cavity 479 configured to receive, and mate with, the first protrusion 462 of the base plate 460. The short side also includes a first end terminating in a lip 476 and a second opposing end coupled with the long side 478. The lip 476 is configured to hookably engage with a channel of a contoured staging platform edge. For example, the lip 476 can protrude away from, e.g., in a direction opposing but parallel to, the base plate 460 such as when the cavity 479 is mated with the first protrusion 462 of the base plate 460 and the long side 478 is substantially flush with the base plate 460. Also, the lip 476 includes an angled edge to accommodate rotation with a channel of a contoured edge of a platform. The long side 478 is disposed along a portion of the first surface 466 of the base plate 460 when the cavity 479 is mated with the first protrusion 462 and the fastener 480 is tightened. The end 472 of the long side opposing the short side 474 is shown terminating in a rounded shape; however, the end 472 can take any variety of shapes.

A fastener 480 is configured to couple the base plate 460 to the L-shaped attachment piece 470 as well as to secure the attachment assembly to a platform edge. The fastener 480 can be a threaded fastener including a tightening knob. To fix the attachment assembly to a platform, the tightening knob is loosened to open the hinged elements, e.g., the base plate 460 and the L-shaped piece 470. Once open, the lower plate, e.g., the second protrusion 464 of the base plate 460, is placed within a lower channel of the contoured edge of a platform. The attachment assembly (or full transport assembly) is rotated upwards toward the platform until the upper hinged plate, e.g., lip 476 of the L-shaped piece 470, rests within an upper channel of the contoured edge. The attachment assembly could optionally be slid along the platform edge to another location, if preferred before tightening the fastener 480. Tightening the knob of the fastener 480 until snug, closes, or clamps, the hinged plates. This brings at least a portion of the long side 478 of the L-shaped piece 470 into contact with the first surface of the base plate 460 and hooks the lip 476 into the upper channel. Thus, tightening the fastener 480 also secures, or locks, the attachment assembly to a position on the platform edge.

To form a transport assembly, a support plate and wheels are coupled to the attachment assembly. For example the support plate comprises a first surface and an opposing second surface where the second surface is coupled to the base plate 460. Two or more wheels are coupled to the first surface of the support plate.

Figure 5A:
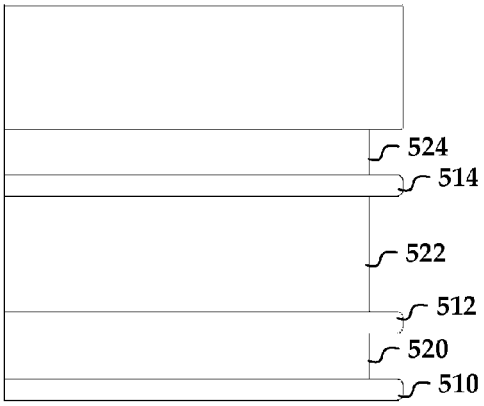
FIG. 5A is a side view of a contoured edge of a platform according to embodiments of the disclosure.
Figure 5B:
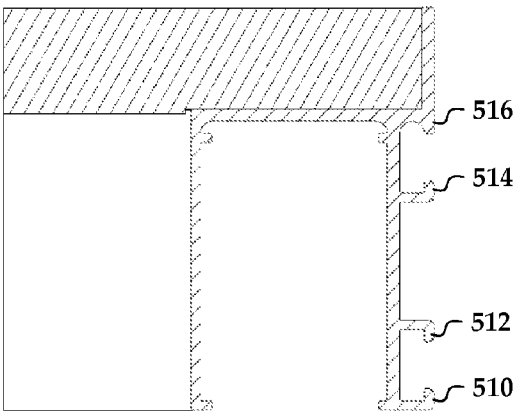
FIG. 5B is a section view of a contoured edge of a platform according to embodiments of the disclosure.

The attachment assembly of a transport assembly is configured to hookably engage, or mate, with a contoured, exterior edge of a staging platform. FIG. 5A illustrates a side view of the contoured edge, and FIG. 5B shows a section, or profile, view of the contouring. The exterior edge can be part of an extruded frame (e.g., extruded aluminum) for holding one or more staging platform panels. Herein, one or more panels encompassed in an extruded frame are referred to as a staging platform. As shown in FIG. 5A, the platform edge is contoured to include a plurality of lips 510, 512, 514 and channels 520, 522, 524 along the length of the platform edge. The lips are positioned to provide channels of various dimensions. For example, the channels can have an opening width from about 0.4 to 1.3 inches and an internal width of from about 0.65 to 1.3 inches. While the interior of two or more channels may have different profile shapes (e.g., channel 524 is rounded and channel 520 is squared), they may share the same approximate dimensions. Also, two or more channels may have the same shapes and/or dimensions or each channel may have differing dimensions. The contouring can be provided on one or more edges, or extend around the circumference, of the platform.

FIG. 5B shows further details of the lipped protrusions of the platform edge. In the following discussion, the terms "up" and "down" refer to directions relative to a support surface such that when a staging platform is in an operating position, the platform is substantially parallel to the support surface (i.e., "up" is the direction away from the support surface and "down" is the direction toward the support surface). Lips 510 and 514 are positioned up to form the bottom, or trough, of channels 520 and 524 respectively. Correspondingly, lips 512 and 516 protrude downward to form the top portion of respective channels 520 and 524. Thus, lip 476 is configured to mate and rotate within channel 524, and the second protrusion 464 of the base plate 460 is configured to mate and hookably engage with channel 520. Channel 522 receives the end of the fastener 484 but the end does not necessarily make contact with an edge of channel 522. As mentioned above, the lips and channels can be a variety of shapes and sizes, so long as they are configured to mate with the terminal end of the L-shaped piece's short side 476 and the second protrusion of the base plate 464. Further, when the attachment assembly is secured to the platform edge, the second surface 468 of the base plate is in contact with lips 514 and 512 as may be seen in FIGS. 7A-B.

Figure 6A:
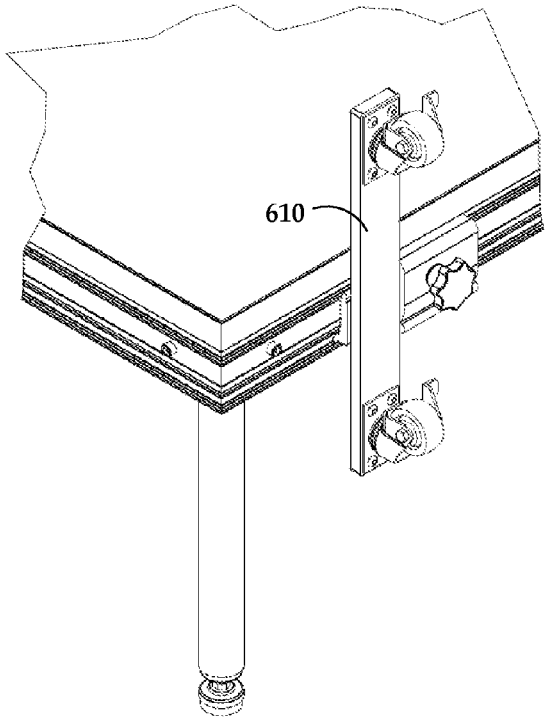
FIGS. 6A-B are perspective views of a transport assembly attached to a platform according to embodiments of the disclosure.
Figure 6B:
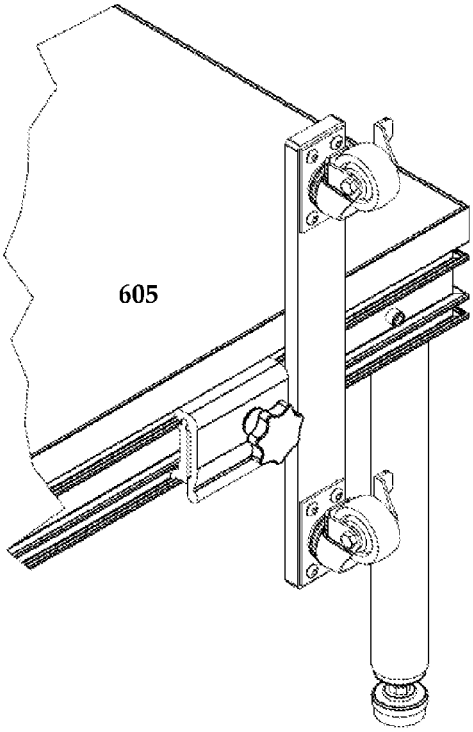
Figure 7A:
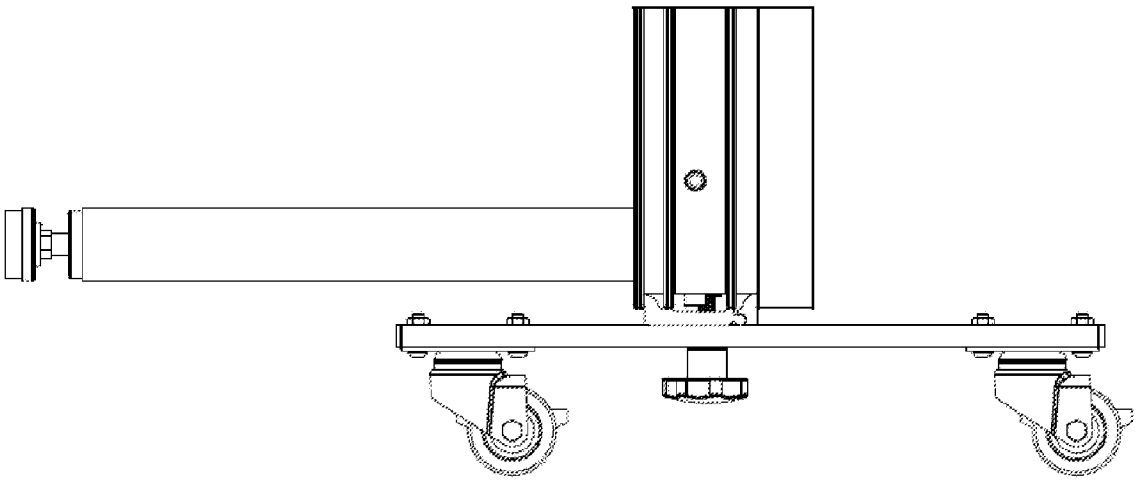
FIG. 7A is a side view of a transport assembly attached to a platform according to embodiments of the disclosure.
Figure 7B:
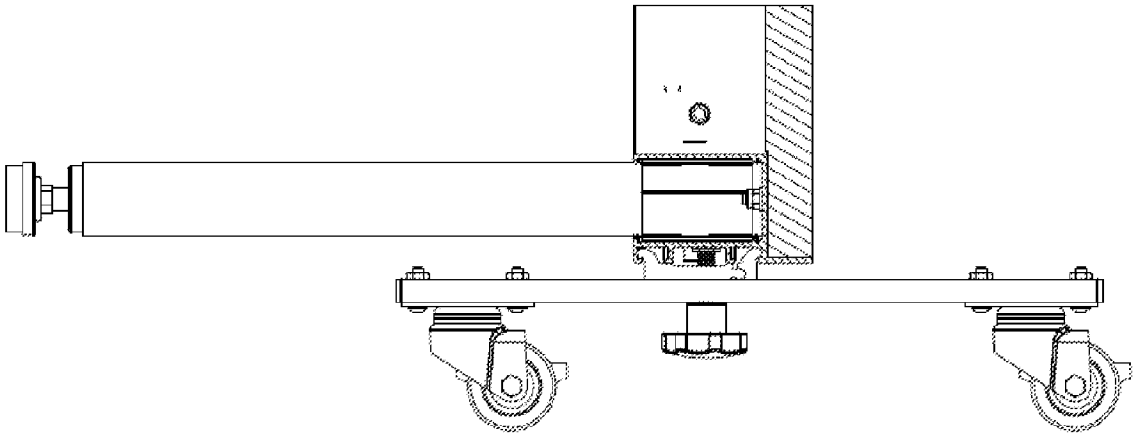
FIG. 7B is a section view of a transport assembly attached to a platform according to embodiments of the disclosure.

When an attachment assembly is hookably engaged with a platform edge, the transport assembly is, or can be, installed. FIGS. 6A-B illustrate a transport assembly installed at opposing ends of a staging platform. The transport assembly is attached so that at least one wheel is positioned on either side of the platform. However, the wheels are not necessarily equidistant from the platform. As shown, more of the support plate 610 extends above the platform 605 than below. The positioning of the support plate 610 is based upon the weight distribution of the staging panel with respect to the platform frame, and optionally support legs, when the staging platform is rotated to a vertical, transport position. For example, staging platforms can be four feet by eight feet and weigh approximately 100-150 pounds. To accommodate the size of the platforms, the length of the support plate 610 can be from about 14 to 18 inches, and preferably about 16 inches for a typical staging platform. FIG. 7A further provides a side view of a transport assembly installed on a staging platform, and FIG. 7B is a section view of the same transport assembly.

Figure 8:
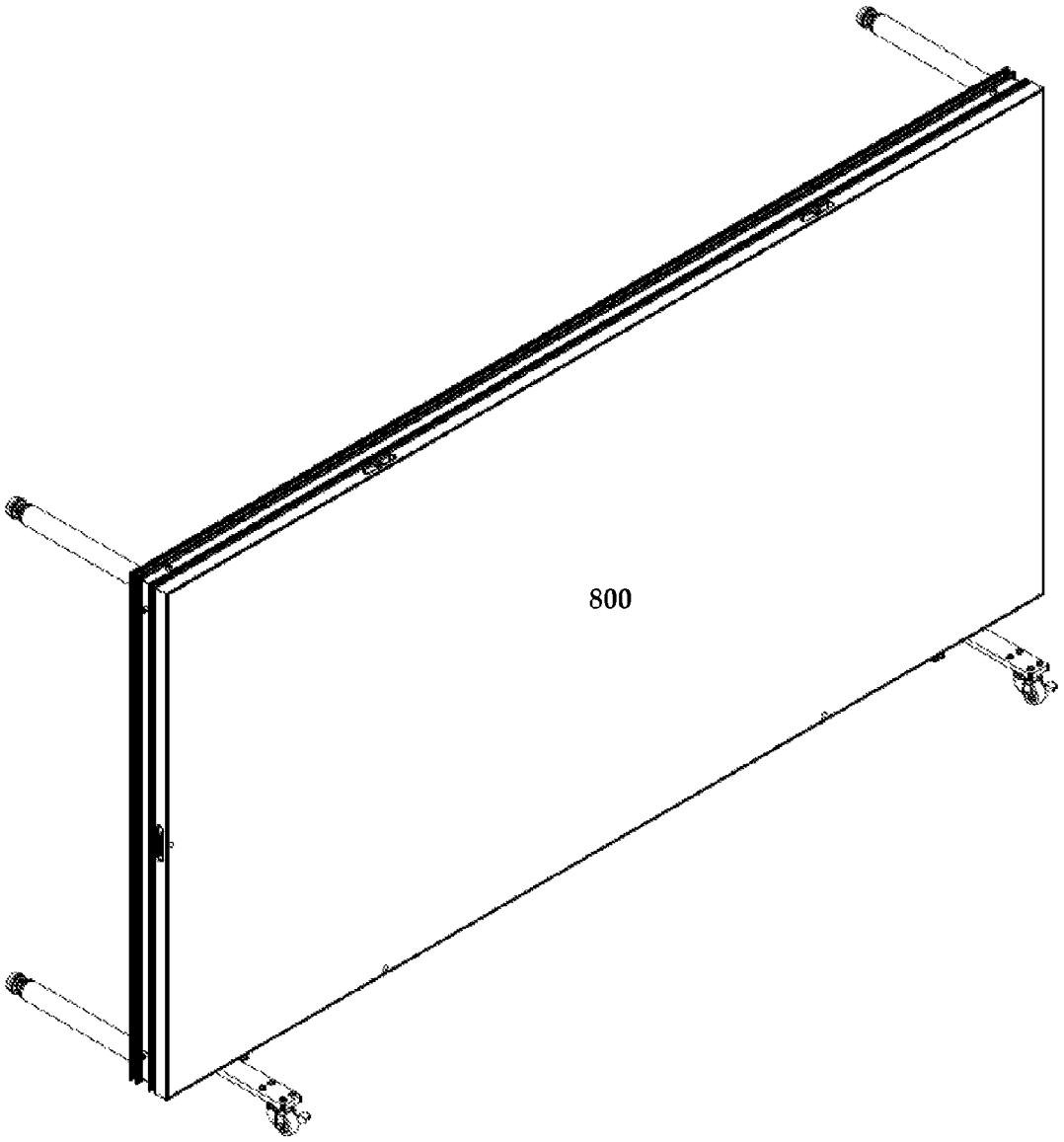
FIG. 8 is a perspective view of a staging transport system in an operating position according to embodiments of the disclosure.
Figure 9:
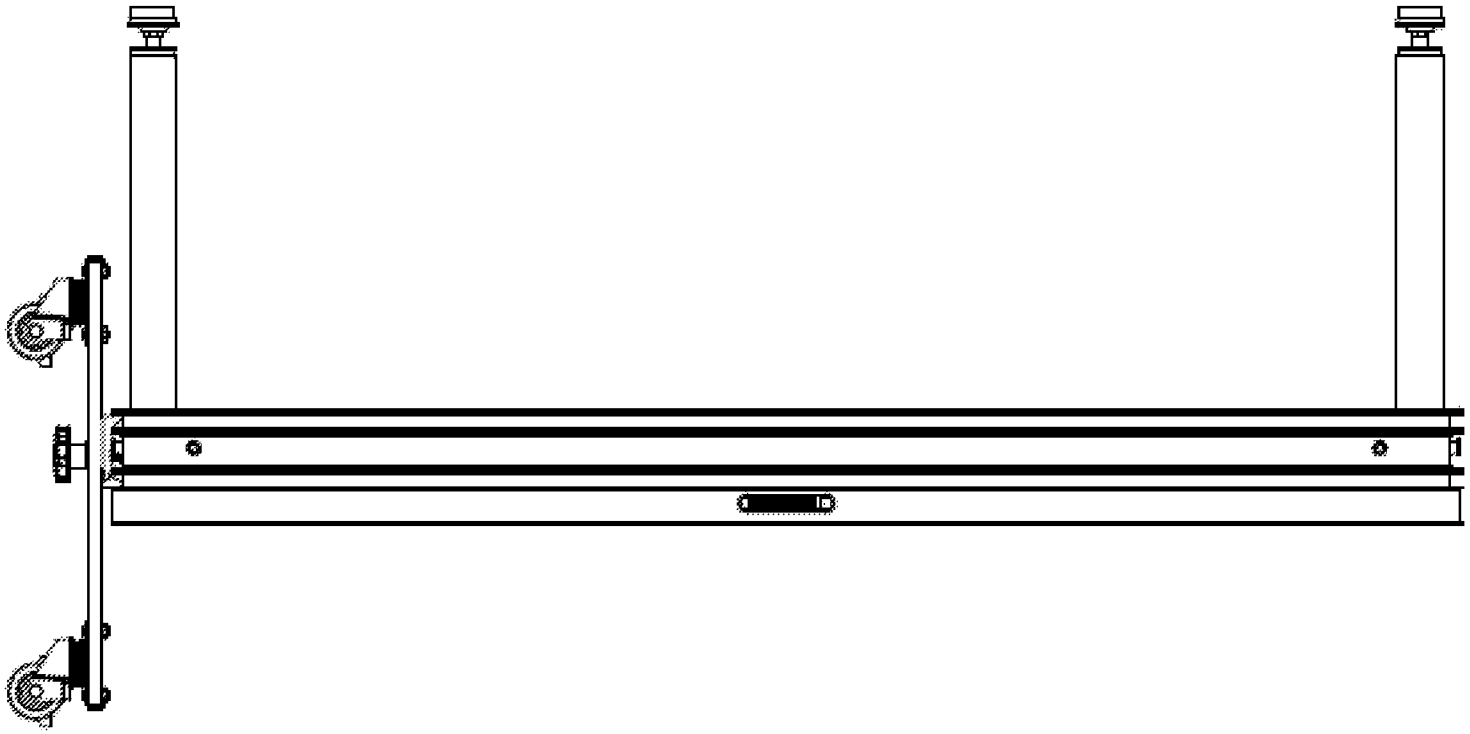
FIG. 9 is a side view of a staging transport system in an operating position according to embodiments of the disclosure.

FIGS. 8 and 9 illustrate a staging platform 800 in a transport position. FIG. 8 provides a perspective view, and FIG. 9 is a side view. The staging platform is rotated ninety degrees from an operational position (e.g., substantially parallel to a support surface) to the platform's side in a transport position (e.g., the wheels of the transport assembly engaged with the support surface). While the legs of the platform are shown extended, such as still in an operational position, the legs can be repositioned to a transport position. For example, the legs can be configured to fold under the platform once the platform is in a transport position. In other embodiments, the legs are removed and then stored adjacent the platform, by securing the legs to a brace installed on the underside of the platform.

Figure 10:
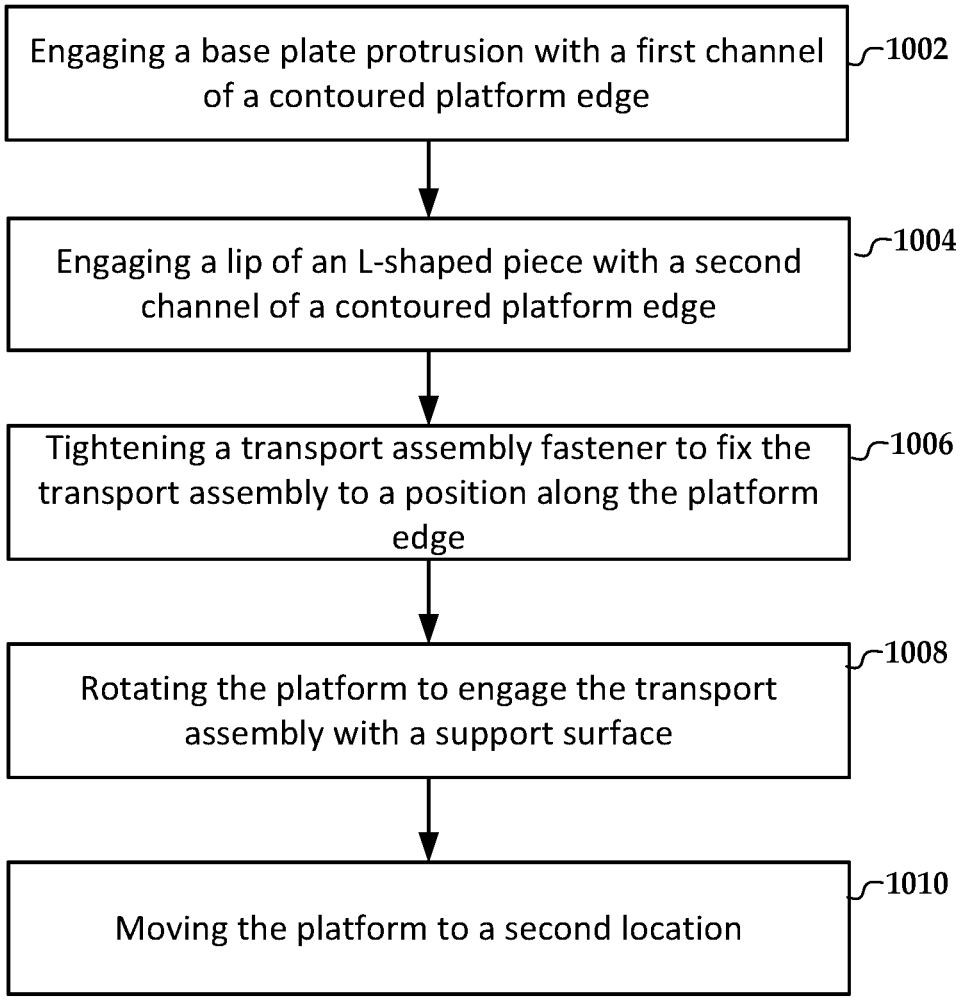
FIG. 10 is a flowchart of a method for assembling a staging transport system according to example embodiments.

Turning to FIG. 10, a method for installing and utilizing a transport assembly, as described herein, is provided. A transport assembly is attached to a staging platform by engaging a protrusion of a transport assembly base plate with a first channel of a contoured edge of a platform 1002, engaging a lip of a transport assembly L-shaped piece with a second channel of the contoured edge of the platform 1004, and tightening a transport assembly fastener to rotate the L-shaped piece to dispose a long side of the L-shaped piece adjacent the base plate and fix the transport assembly to a position along the contoured edge 1006. The edge surface of the platform can be an extruded, exterior frame of the platform and is contoured to mate with an attachment assembly of the transport assembly. For example, the edge surface includes a plurality of channels and lips to hookably engage, or mate, with lips and/or protrusions along the attachment assembly of the transport assembly. In some embodiments, a transport assembly fastener is released, or loosened, to open hinged portions of an attachment assembly (e.g., allow an L-shaped piece to rotate about an edge of the base plate). The base plate protrusion may be inserted into a first channel to hook an edge of the base plate into the channel. Then a lip of the L-shaped piece is inserted into a second channel. The fastener is then tightened, e.g., rotated, to close the hinged portions, e.g, clamp them together, thereby further rotating the lip to hook into the second channel and lock the attachment assembly in place. These steps can be repeated to attach a second transport assembly, or more, to the same platform.

After the transport assembly, or plurality of transport assemblies, is installed on the platform, the staging platform is rotated to engage the transport assembly with a support surface 1008. For example, the platform may be in a first, operating state (e.g., the platform substantially parallel to a support surface) and then tipped, or rotated, to a second, transport state (e.g., the platform substantially perpendicular to the support surface). In the transport state, the wheels of the transport assembly are in contact with the support surface and the platform rests on the one or more transport assemblies. The staging platform can then be moved, e.g., rolled, to a second location such as a truck for removal from the premises or a storage location 1010. Once in a storage location, the wheels of the transport assembly can optionally be locked. When the operating position includes the platform being supported by legs, the legs can be repositioned to be substantially adjacent to the platform for transporting and storage purposes. For example, the legs can be configured to fold up toward the platform, or the legs could be removed from the platform and attached to the underside of the platform. With or without the legs being repositioned, multiple platforms can then be stored in the transport position in a nested configuration. The transport assemblies remain affixed to the platform for efficient movement, e.g., placement, when staging is next required.

In alternative embodiments, the staging platform can be folded to utilize one or more transport assemblies. As discussed above, one or more transport assemblies are attached to an edge of a platform. The platform can comprise one or more hinged sections such that the sections can be folded on to one another to reduce the platform area for ease of transport and storage. For example, the platform can comprise two hinged panels that can be folded to be substantially adjacent each other. In certain embodiments, the two-paneled platform may start in an operating position supported by legs. The one or more transport assemblies are attached to an edge of a first panel. Then the second panel is folded over so that the top surfaces of the two panels are substantially adjacent each other. The folded platform can then be rotated to place the one or more transport assemblies on the support surface to support the folded platform on the one or more transport assemblies. The legs can be repositioned, e.g., folded, to be substantially adjacent the panels. In this embodiment, the legs would be on the exterior of the folded platform. The two panels can also optionally be fixed, or locked together to prevent the panels from separating during transport or storage.

In alternative embodiments, after one or more transport assemblies are attached to an edge of a first panel, the platform can be rotated to place the one or more transport assemblies on the support surface. The legs can be repositioned adjacent the panels, and the second panel can be folded down to be substantially adjacent the first panel. In this embodiment, the legs would be on the interior of the folded platform. The two panels can also optionally be fixed, or locked together to prevent the panels from separating during transport or storage. Embodiments involving folded platforms can similarly involve three or more hinged panels.

It is understood that staging systems as discussed herein may be used with various accessories and devices. For example, railings, step units, and other accessories may also be suitably arranged at any desirable location on the staging platforms. These accessories may be also attached to the contoured edge of the boxed extrusion of the staging platform frame and share the contoured edge with one or more transport assemblies.

The foregoing description of the exemplary embodiments of the disclosure has been presented for the purposes of illustration and description. It is not intended to be exhaustive or to limit the disclosure to the precise form disclosed. Many modifications and variations are possible in light of the above teaching. It is intended that the scope of the disclosure be limited not with this detailed description, but rather determined by the claims appended hereto.

What is claimed is:

1. A staging transport assembly, comprising:

a base plate comprising a first edge having a first protrusion and a second opposing edge having a second protrusion and further comprising a first surface and a second opposing surface;

an L-shaped attachment piece, wherein a short side comprises a cavity configured to receive the first protrusion of the base plate, a first end terminating in a lip and a second opposing end coupled with a long side, where the long side is disposed along a portion of the first surface of the base plate when the cavity is mated with the first protrusion;

a fastener configured to couple the base plate to the L-shaped attachment piece;

a support plate comprising a first surface and an opposing second surface where the second surface is coupled to the base plate; and at least two wheels coupled to the first surface of the support plate.

2. The assembly of claim 1, wherein the lip of the short side of the L-shaped attachment piece protrudes away from the base plate when the cavity is mated with the first protrusion.

3. The assembly of claim 1, wherein the fastener is a threaded fastener.

4. The assembly of claim 1, wherein the fastener is further configured to secure the staging transport assembly to a staging platform.

5. The assembly of claim 1, wherein the base plate is adjacent the L-shaped fastener when the fastener is tightened.

6. The assembly of claim 1, wherein the L-shaped attachment plate and the base plate comprise respective apertures configured to receive the fastener.

7. A portable staging system, comprising:

a staging platform comprising at least one contoured edge surface; and at least one transport assembly comprising at least two wheels coupled to a first surface of a support plate, wherein an opposing, second surface of the support plate is coupled to an attachment assembly, wherein the attachment assembly comprises:

a base plate comprising a first edge having a first protrusion and a second opposing edge having a second protrusion and further comprising a first surface and a second opposing surface;

an L-shaped piece, wherein a short side comprises a cavity configured to receive the first protrusion of the base plate, a first end terminating in a lip and a second opposing end coupled with a long side, where the L-shaped piece is rotatable about the first protrusion when the cavity is mated with the first protrusion; and a fastener configured to couple the base plate to the L-shaped piece and wherein the attachment assembly is hookably engaged with the contoured edge surface of the staging platform.

8. The system of claim 7, wherein the staging platform comprises at least three legs for engaging a support surface, and when the staging platform is in a position for use substantially parallel to the support surface where the legs engage the support surface, the at least one transport assembly is substantially parallel to the legs and suspended above the support surface.

9. The system of claim 8, wherein a majority of the length of the support plate is positioned below a bottom surface of the staging platform when the platform is in the position for use.

10. The system of claim 7, wherein the contoured edge surface comprises a plurality of channels and lips and the attachment assembly comprises corresponding mating protrusions for hooked engagement with the contoured edge surface.

11. The system of claim 7, wherein the second protrusion of the base plate and the lip of the short side of the L-shaped attachment piece are configured to hookably engage the contoured edge surface of the staging platform.

12. The system of claim 7, wherein the attachment assembly is fastened to the staging platform.

13. The system of claim 7, wherein the transport assembly comprises at least three wheels.

14. The system of claim 7, wherein the support plate is removable.

15. The system of claim 7, comprising at least two transport assemblies.

16. The system of claim 7, wherein the staging platform comprises two panels configured to fold to a collapsed position where a first panel is substantially adjacent the second panel.

17. A method, comprising:

engaging a protrusion of a transport assembly base plate with a first channel of a contoured edge of a platform;

engaging a lip of a transport assembly L-shaped piece with a second channel of the contoured edge of the platform;

tightening a transport assembly fastener to rotate the L-shaped piece to dispose a long side of the L-shaped piece adjacent the base plate and fix the transport assembly to a position along the contoured edge;

rotating the staging platform to engage the transport assembly with a support surface; and moving the staging platform to a second location.

18. The method of claim 17, further comprising:

folding the staging platform to position a first panel substantially adjacent a second panel.

19. The method of claim 17, wherein three or more legs are coupled to the staging platform and the method includes positioning the legs substantially adjacent the staging platform in a position for transport.

* * * * *